US005261615A

United States Patent [19]

Cuttelod

[11] Patent Number: 5,261,615

[45] Date of Patent: Nov. 16, 1993

[54] PROCESS FOR MANUFACTURING ELECTRONIC COMPONENTS COMPRISING A FINE-WIRE WINDING, AND DEVICE FOR HOLDING THE WINDING WIRE PERMITTING MANUFACTURE ACCORDING TO THIS PROCESS

[75] Inventor: Daniel Cuttelod, Tatroz, Switzerland

[73] Assignee: Sokymat SA, Switzerland

[21] Appl. No.: 656,137

[22] PCT Filed: Jun. 29, 1990

[86] PCT No.: PCT/CH90/00158

§ 371 Date: Mar. 1, 1991

§ 102(e) Date: Mar. 1, 1991

[87] PCT Pub. No.: WO91/00603

PCT Pub. Date: Jan. 10, 1991

[30] Foreign Application Priority Data

Jul. 3, 1989 [CH] Switzerland ..... 2469/89

[51] Int. Cl.[5] ..... H01F 41/06

[52] U.S. Cl. ..... 242/7.02; 242/7.09; 242/7.11

[58] Field of Search ..... 242/7.14, 7.03, 7.09, 242/7.13, 7.11

[56] References Cited

U.S. PATENT DOCUMENTS

| | | | |
|---|---|---|---|
| 2,987,804 | 6/1961 | Nichol | 242/7.03 |
| 3,409,980 | 11/1968 | Lawless et al. | 242/7.09 |
| 3,508,316 | 4/1970 | Hill | 242/7.09 |
| 3,628,575 | 12/1971 | Hill | 242/7.09 X |
| 3,865,152 | 2/1975 | Camardella | 242/7.09 |
| 3,938,748 | 2/1976 | Camardella | 242/7.14 X |
| 4,121,627 | 10/1978 | Schmid | 242/7.09 |
| 4,558,835 | 12/1985 | Sunaoka | 242/7.14 X |
| 4,635,865 | 1/1987 | Arnold | 242/7.03 |
| 4,785,527 | 11/1988 | Bernard et al. | 242/7.09 |

*Primary Examiner*—Katherine Matecki

*Attorney, Agent, or Firm*—Zarley, McKee, Thomte, Voorhees & Sease

[57] ABSTRACT

A process for mass production of electronic components includes the steps of gripping the output and input wires extending from a wire core as mounting plates which carry the cores pass over a winding head which distributes wire to each core. The wire is gripped by an operable holding device located a predetermined distance from the wire cores to provide a sufficient free length of the wires to bring the wires into a position readily available for a following operation.

4 Claims, 2 Drawing Sheets

PROCESS FOR MANUFACTURING ELECTRONIC COMPONENTS COMPRISING A FINE-WIRE WINDING, AND DEVICE FOR HOLDING THE WINDING WIRE PERMITTING MANUFACTURE ACCORDING TO THIS PROCESS

BACKGROUND OF THE INVENTION

Different types of machines exist permitting the winding of cores intended to be integrated as a component in an electronic circuit, particularly in a watch circuit.

The coils intended for such circuits are characterized by their small size, as well as by the use of a very fine winding wire, of a diameter on the order of a few hundredths of a millimeter.

According to the prior art, whether the winding is produced by rotation of the core opposite the wire-distributing reel or by rotation of a flyer leading the wire from the payout reel onto a stationary core, the free ends of the wire at the input and at the output of the winding are either cut and left free or are led directly onto spindles where they are automatically wound in order to be taken up again later on for the following operation.

Because the wire in question is extremely fine, it will be difficult and tedious, when the ends are free, to find them again with a view to the following operation, in order to position them on soldering contact-studs, for example, or for any other operation. This delicate searching phase is generally done by hand, the operator searching for each wire with the aid of suitable instruments, tweezers, for example, before bringing said wires into position ready for the following operation. The minute detail and the attention necessary for this search, as well as the necessity of exercising only a minimum of stress on the wire owing to its low mechanical resistance, have heretofore made the mechanization and automation of this operational phase difficult.

In the case where the ends have been brought and directly wound around auxiliary spindles, taking these wires up again with a view to the later operation may prove to be delicate, for the input and output wires, drawn tight between the ends of the winding and the spindles, are hard to recover without breaking the wire; the devices foreseen for that purpose are generally complicated and not very flexible to use.

Moreover, according to certain designs for winding devices, the supports serving to hold the core during winding hide the points where the wire will come to be fixed later; it is therefore necessary to provide for an additional manufacturing operation consisting in changing the manner of holding the winding.

Hence these ways of proceeding, according to the prior art, significantly increase the cost of the finished coil.

The object of the invention is precisely, while preserving and keeping known the exact position of a sufficient length of the input and output wires of the coil and while having available a sufficient free length of each of these wires, available without its being necessary to apply to them an excessive tractive force, to be able to bring said wires, by simple mechanical and/or automatic means, into a position ready to be available for the following operation, respectively, to be soldered.

A device for holding the wire permitting the carrying out of this process also forms part of the invention. The process of the invention as well as the device associated therewith are described in the drawing, according to a possible embodiment.

DESCRIPTION OF THE PREFERRED EMBODIMENTS

Figure 1:
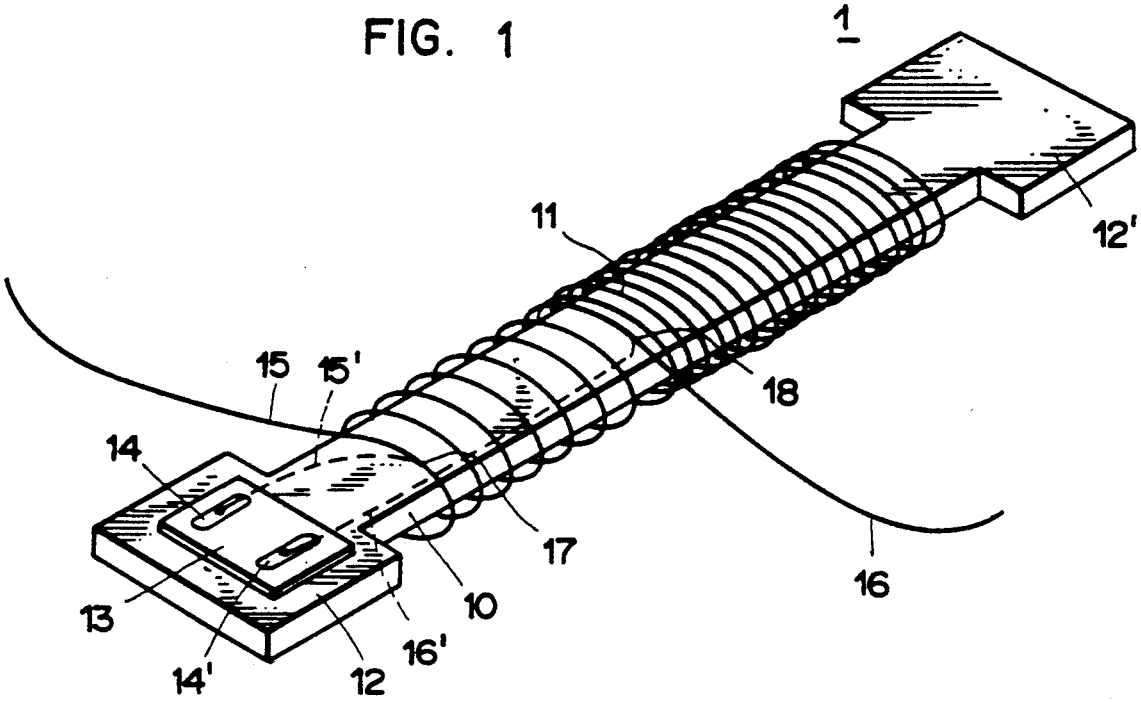
FIG. 1 depicts an embodiment of a winding used as a component of an electronic circuit.

A coil 1, used as a component of an electronic circuit, is made up, according to an embodiment depicted in FIG. 1, of a core 10 terminated at its two ends by tags 12 and 12', of a plurality of turns of fine wire forming a winding 11, of an insulating pellet 13 including two soldering contact-studs 14 and 14' fixed on the tag 12 of the core. The free ends of the input wire 15 and of the output wire 16 may be loose starting from the entry point 17 and exit point 18 of the winding, or else fixed to auxiliary spindles not shown here, and it is difficult, considering the fineness of the wire used, to recover them and lead them onto the soldering contact-studs 14 and 14' to be soldered there, as depicted in broken lines by 15' and 16'.

Other types of coils may be considered suitable for being manufactured according to the process of the invention, especially coils comprising cores provided with cheeks on which the flanks of the winding may rest or else windings not comprising any core.

Figure 2:
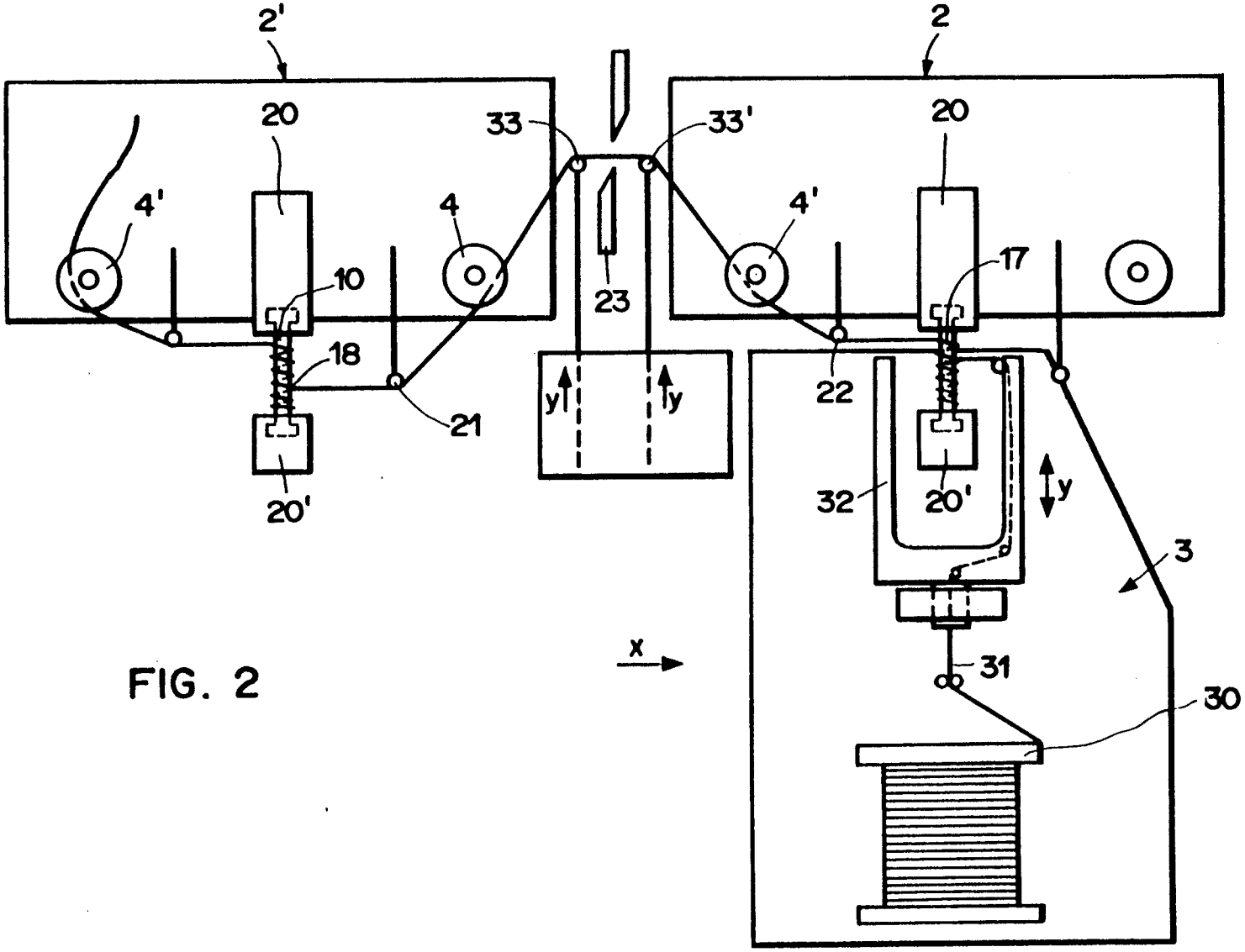
FIG. 2 depicts a plan view of an arrangement according to a possible embodiment, carrying out the process.

The arrangement depicted in FIG. 2 illustrates various stages of manufacture of a coil according to the process. We have available a series of mounting plates 2, 2', two of which are depicted here side by side. These mounting plates all comprise a holding device 20, 20' for the core 10. A distributing head 3 has a step-by-step longitudinal relative movement according to X, bringing it to become positioned in front of each mounting plate in order to undertake the winding of the core 10. This distributing head includes a payout reel 30 supplying the wire 31 to a flyer 32 which, being in rotation about the core 10, deposits the wire on the latter according to the number of turns desired. A transverse displacement according to Y of the flyer 32 permits regular laying of the wire 31 in close turns on the core 10.

At the time of the passage of the distributing head 3 from the mounting plate 2', where winding is finished, to the mounting plate 2, where winding is to take place, the wire has been drawn tight by the two movable guides 33 and 33' effecting the movement and, starting from the point of exit from the winding 18, by the exit guide 21, the device 4 for holding the output wire, that 4' for holding the input wire, which have been actuated automatically in order to receive the wire, as will be explained below, and the entry guide 22 of the mounting plate 2, and thence toward the entry point 17 of the winding to be produced.

Figure 3:
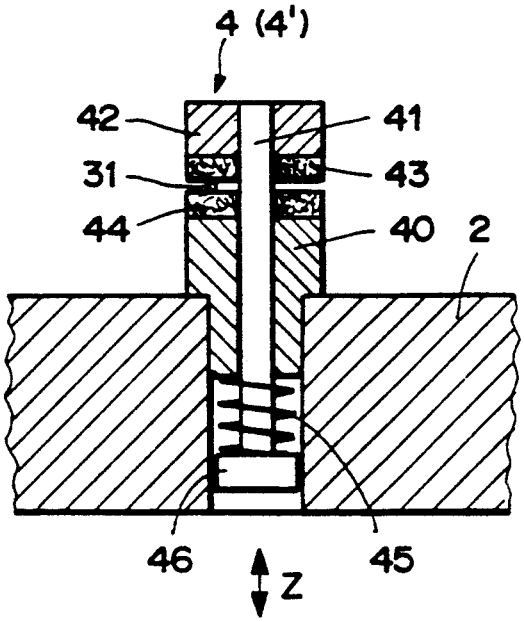
FIG. 3 depicts a possible embodiment of a device according to the invention, allowing execution of the process.

The output- and input-wire holding devices 4, 4' ensure tensing of the wire and hold it in position after it has been cut by a device shown at 23. A possible design of the holding device 4 of the output wire and 4' of the input wire, respectively, is depicted in FIG. 3, the design being identical in both cases.

This device, according to a preferred design, is made up of a base 40 fixed to the mounting plate 2 or 2' by a screw thread or any other process, partially traversing said mounting plate through a hole provided for that purpose and protruding by a support flange on the upper surface of the mounting plate, of a pin 41 able to slide freely and vertically according to the movement Z within a hole passing through said base, of a washer 42 fixed integrally to the top of the pin 41, of two felt washers 43 and 44 which squeeze the wire between them, and of an actuating device made up of a compression spring 45 and of a support washer 46, fixed integrally to the bottom of the pin 41.

At the time of the relative displacement of the distributing head 3, passing from the mounting plate 2' to the mounting plate 2, while the two movable guides 33 and 33' advance so as to push the wire, a device, not shown here, presses on the support washer 46, thus moving the pin 41 upward while compressing the spring 45 and thus separating the two felt washers 43 and 44 so that the wire can become lodged between them. As soon as this operation is accomplished, the action upon the support washer 46 ceases, the spring 45 causing the pin 41 and, consequently, the upper washer 42 as well as the felt washer 43 to redescend, until the wire is squeezed between the felt washers 43 and 44.

The wire connecting two windings placed on successive mounting plates can then be cut by the device 23, the wire remaining drawn tightly between the input-wire holding device 4' and the point of entry to the winding 17, passing by the entry guide 22, and between the output-wire holding device 4 and the point of exit from the winding 18, passing by the exit guide 21, respectively.

The free ends of the input and output wires, between the holding devices 4 and 4', respectively, and the cutting point 23, are available and in reserve in order that, when the wire portions situated between the point of entry to the winding 17 and the entry guide 22, and between the point of exit from the winding 18 and the exit guide 21, respectively, have been taken up again by an appropriate device, not shown here, in order to lead them onto the soldering contact-studs 14 and 14' to be soldered there, said free ends will slide between the felt washers 43 and 44 of the holding devices 4 and 4' in order to give the wire the sufficient taut length for being correctly led onto said soldering contact-studs.

The step-by-step longitudinal relative movement between the distributing head 3 and the mounting plates 2, 2', respectively, will preferably take place by movement of said mounting plates 2 and 2' in front of the distributing head 3, which remains fixed.

The process by which the position of a sufficient length of the ends of the input and output wires of a winding is preserved and is known, and by which a sufficient free length of said input and output wires is available in order that the said wires remain taut when they are brought into position for being soldered there on the same machine, also accommodates itself to other arrangements than that depicted here; in particular, the mounting plates depicted here side by side may be disposed in various other ways, particularly in carrousel.

The wire holding device 4 or 4', too, may be made up differently than described here; in particular, in the case where the upper washer 42 exerts sufficient pressure in order to hold the wire between the felt washers, it is possible to arrange the device without the spring 45. The washers 43 and 44, provided here of felt, may also be made of any appropriate materials, for example of synthetic foam, of rubber, or of leather, it not being obligatory that the two washers are of the same material. It is well understood that, according to the machine depot available or according to the operation following that of winding, the elements described here and forming the mounting plate 2 may form part of a stock mounting plate capable of being transferred later to another machine for the following operation.

It is obvious that the process of the invention, as well as the holding device, may be used separately or in association for the winding of wires of all diameters capable of being wound according to this process.

I claim:

1. A process for mass production of electronic components comprising the steps of:

providing a plurality of cores projecting from a plurality of mounting plates;

providing a winding head for sequentially winding a wire around each of said plurality of cores, said winding head including at least one rotatable arm for guiding a wire from a supply reel around each said core;

holding a portion of a wire extending from said arm with a first holding device, the holding device located adjacent a first core of said plurality of cores, such that a wire free end extends from the first holding device;

relatively moving said winding head and said first core to a winding position where said winding head is aligned with said first core such that wire is pulled from said winding head arm in a taut condition between said first holding device and said first core;

operating said winding head to form a coil winding on said first core;

relatively moving said winding head and said first core to a second winding position where said winding head is aligned with a second core of said plurality of cores such that wire is pulled from said winding head in a taut condition from said first core to said second core, said wire extending from the first core to the second core including an output wire portion extending from the first core and an input wire portion extending from the output wire portion to the second core;

holding a portion of the output wire portion in a second holding device to maintain a taut output wire reserve portion between the second holding device and the first core;

holding a portion of the input wire portion in a third holding device to maintain a taut input wire reserve between the third holding device and the second core; and cutting the wire between the second and third holding devices to create an output wire reserve free end extending freely from the second holding device, and an input wire free end extending freely from the third holding device.

2. The process of claim 1 further comprising the steps of repeating the following steps for each core of the plurality of cores:

(a) operating the winding head to form a coil winding;

(b) relatively moving the winding head to a subsequent winding position aligned with a subsequent core of said plurality of cores;

(c) holding a portion of an output wire from the previous core;

(d) holding a portion of the input wire to the next subsequent core; and (e) cutting the wire between the previous core and subsequent core.

3. A process for mass production of electronic components comprising the steps of:

providing a plurality of cores projecting from a plurality of mounting plates;

providing a winding head for sequentially winding a wire around each of said plurality of cores, said winding head including at least one rotatable arm for guiding a wire from a supply reel around each said core;

holding a portion of a wire extending from said arm with a first holding device such that a wire free end extends from the first holding device;

moving said plurality of cores to a winding position with said first core aligned with said winding head such that wire is pulled from said winding head arm in a taut condition between said first holding device and said first core;

operating said winding head to form a coil winding on said first core;

moving said plurality of cores to a second winding position with a second core of said plurality of cores aligned with said winding head such that wire is pulled from said winding head in a taut condition from said first core to said second core, said wire extending from the first core to the second core including an output wire portion extending from the first core and an input wire portion extending from the output wire portion of the second core;

holding a portion of the output wire portion in a second holding device to maintain a taut output wire reserve portion between the second holding device and the first core;

holding a portion of the input wire portion in a third holding device to maintain a taut input wire reserve between the third holding device and the second core; and cutting the wire between the second and third holding devices to create an output wire reserve free end extending freely from the second holding device, and an input wire free end extending freely from the third holding device.

4. The process of claim 3 further comprising the steps of repeating the following steps for each core of the plurality of cores:

(a) operating the winding head to form a coil winding;

(b) moving the plurality cores to a subsequent winding position with a subsequent core aligned with said winding head;

(c) holding a portion of an output wire from the previous core;

(d) holding a portion of the input wire to the next subsequent core; and (e) cutting the wire between the previous core and subsequent core.

* * * * *